US010119101B2

(12) United States Patent
Peitersen et al.

(10) Patent No.: US 10,119,101 B2
(45) Date of Patent: Nov. 6, 2018

(54) METHOD OF MINIMIZING ENZYME BASED AEROSOL MIST USING A PRESSURE SPRAY SYSTEM

(71) Applicant: Ecolab USA Inc., St. Paul, MN (US)

(72) Inventors: Nathan D. Peitersen, Apple Valley, MN (US); Charles Allen Hodge, Cottage Grove, MN (US); Terrence Phillip Everson, Eagan, MN (US); Stephen James Engel, Rosemount, MN (US)

(73) Assignee: Ecolab USA Inc., St. Paul, MN (US)

( * ) Notice: Subject to any disclaimer, the term of this patent is extended or adjusted under 35 U.S.C. 154(b) by 199 days.

(21) Appl. No.: 14/263,003

(22) Filed: Apr. 28, 2014

(65) Prior Publication Data

US 2015/0307817 A1 Oct. 29, 2015

(51) Int. Cl.

| | |
|---|---|
| ***C11D 3/386*** | (2006.01) |
| ***C11D 11/00*** | (2006.01) |
| ***A47L 13/51*** | (2006.01) |
| ***B08B 3/02*** | (2006.01) |
| ***B08B 3/04*** | (2006.01) |

(52) U.S. Cl.

CPC ..... *C11D 3/38627* (2013.01); *A47L 13/51* (2013.01); *B08B 3/026* (2013.01); *C11D 11/0064* (2013.01); *B08B 3/04* (2013.01); *B08B 2203/0217* (2013.01)

(58) Field of Classification Search

None

See application file for complete search history.

(56) References Cited

U.S. PATENT DOCUMENTS

| | | | |
|---|---|---|---|
| 3,680,786 | A | 8/1972 | Levy |
| 3,934,005 | A | 1/1976 | Albert |
| 6,070,808 | A | 6/2000 | Kildow |
| 2003/0092589 | A1 | 5/2003 | Todini et al. |
| 2003/0109399 | A1 | 6/2003 | Todini et al. |
| 2004/0067322 | A1 | 4/2004 | Baker et al. |

(Continued)

FOREIGN PATENT DOCUMENTS

| | | |
|---|---|---|
| JP | 1207154 | 8/1989 |
| JP | 2013177546 | 9/2013 |

(Continued)

OTHER PUBLICATIONS

JP 1-207154, Riko Kiyousan KK—English. Aug. 21, 1989.

(Continued)

*Primary Examiner* — Nicole Blan

(74) *Attorney, Agent, or Firm* — Merchant & Gould P.C.

(57) ABSTRACT

Disclosed herein are methods for improving safety and delivery of commercial application of cleaning compositions that include enzymes and other protein irritants. The methods reduce the mist and aerosolization of proteins so that inhalation and exposure to the same are reduced. According to the invention, when commercial pressurized sprayers are used to apply protein containing use cleaning compositions of up to 5 ppm protein, aerosolization is decreased to below 60 ng active protein per meter cubed. Applicants have also identified a specific metering tip/nozzle, dispense rate, and low pressure application of not more than 100 psi are critical to achieving the benefits of the invention.

21 Claims, 4 Drawing Sheets

(56) References Cited

U.S. PATENT DOCUMENTS

| | | | | |
|---|---|---|---|---|
| 2004/0138079 | A1 | 7/2004 | Becker et al. | |
| 2007/0187528 | A1* | 8/2007 | Roth | B08B 3/026 239/146 |
| 2008/0193650 | A1 | 8/2008 | Lyon | |
| 2010/0140369 | A1 | 6/2010 | Siernos et al. | |
| 2010/0258142 | A1 | 10/2010 | Kawaguchi et al. | |
| 2012/0070388 | A1* | 3/2012 | Man | A61K 8/068 424/59 |
| 2012/0208736 | A1* | 8/2012 | Waite | C08G 73/02 510/400 |
| 2012/0241537 | A1* | 9/2012 | Schwei | A61L 2/22 239/147 |
| 2012/0312390 | A1 | 12/2012 | Olson et al. | |
| 2013/0133702 | A1* | 5/2013 | Reid | B05B 1/14 134/30 |
| 2014/0020719 | A1 | 1/2014 | Kubasiewicz | |

FOREIGN PATENT DOCUMENTS

| | | |
|---|---|---|
| WO | 1999043771 | 9/1999 |
| WO | 2006014348 | 2/2006 |
| WO | 2010/084387 A2 | 7/2010 |

OTHER PUBLICATIONS

JP 2013-177546, Kohjin Holdings Co Ltd—English. Sep. 9, 2013.
International Search Report, International Application No. PCT/US2015/027853, dated Aug. 3, 2015.
Risk Assessment Guidance for Enzyme-Containing Products, The Soap and Detergent Association; (2005).
Exposure measurements of enzymes for risk assessment of household cleaning spray products, AISE, (2013).
Safety Data Sheet, Novozymes, Lipex 100 L (2015).
Basketter, "Defining Occupational and consumer exposure limits for enzyme protein respiratory allergens under REACH," Toxicology 268 (2010) 165-170.
WashJet Spray Nozzles, High Impact Spray, Optimization Tips.
Spray Particle Size Vs. Pressure, Spray Systems Co.
Extended European Search Report for Application No. 15785765.7 dated Oct. 23, 2017.

* cited by examiner

1/8" to 1/4" NPT or BSPT (M)

METHOD OF MINIMIZING ENZYME BASED AEROSOL MIST USING A PRESSURE SPRAY SYSTEM

FIELD OF THE INVENTION

The invention relates to methods and practices for safe application of chemical compositions containing enzymes or other proteins, delivered through pressurized devices such as pumps or sprays. Aerosolization of proteins can pose a health hazard if the proteins become airborne and are ingested by users. The methods are particularly adapted to use of pressurized delivery devices that carry and deliver such compositions in commercial applications.

BACKGROUND OF THE INVENTION

Aqueous sprayable compositions can be applied to a hard surface with a transient trigger spray device or an aerosol spray device. These compositions have great utility because they can be applied by spray to vertical, overhead or inclined surfaces. Spray devices create a spray pattern of the aqueous sprayable composition that contacts the target hard surfaces. The majority of the sprayable composition comes to reside on the target surface as large sprayed-on deposits, while a small portion of the sprayable composition may become an airborne aerosol or mist, which consists of small particles of the cleaning composition that can remain suspended or dispersed in the atmosphere surrounding the dispersal site for a period of time, such as between about 5 seconds to about 10 minutes. Suspension and dispersion makes these particles available for ingestion by the user and can pose a health risk, particularly if proteins or other enzymes are inhaled.

Enzymes are important constituents in modern detergent products. They are proteins which catalyze chemical reactions and they break down soils and stains. Enzymes are allergens and can cause respiratory allergy similar to other allergens like pollen, dust mites and animal dander. When allergens are inhaled in the form of dust or aerosols they may give rise to formation of specific antibodies which can result in sensitization by the immune system. Upon further exposure people can develop respiratory allergy with symptoms similar to those of asthma and hay-fever. These symptoms can include itching and redness of the mucous membranes, water eyes/nose, sneezing, nasal or sinus congestion, hoarseness of shortness of breath, coughing, and tightness of the chest. Proteolytic enzymes can cause eye irritation, and skin irritation.

Long term exposure to these irritants, through repetitive application can cause significant problems. Many times upon breathing the finely divided aerosol or mist, a very strong and irrepressible choking response is seen in most individuals that come in contact with irritating proportions of the aerosol produced by typical spray-on cleaners. The choking response is inconvenient, reduces cleaning efficiency in a variety of applications and in sensitive individuals can cause asthma attacks, respiratory damage, or other discomfort or injury.

It generally thought that reducing aerosolization of enzymes involves increasing the viscosity of the solutions or is limited to application of only naturally viscous solutions. Enzyme aerosolization, however, is dependent on a number of different parameters, e.g. formulation, enzyme concentration in product, habits and practices of the consumer and nozzle device. High viscosity formulations and foam-sprays were thought to generate lower enzyme exposure than liquid formulations of low viscosity.

Applicants have identified methods for application of water thin and other low viscosity enzyme containing solutions thus reducing the proteins present in any airborne aerosol or mist associated with the same. The following summary is made by way of example and not by way of limitation. It is merely provided to aid the reader in understanding some of the aspects of the invention.

SUMMARY OF THE INVENTION

Applicants have identified particular methods of application for use in commercial and industrial spraying systems that reduce the mist and aerosolization of proteins present in cleaning solutions. This will lead to less health risk for janitors and other professionals who use these carts and solutions on a recurring basis. The reduction in health risk will results in less missed days of work, improved efficiency and less discomfort for employees.

According to the invention, when commercial pressurized spraying systems are used to apply cleaning compositions which employ protein or other irritants that can become aerosolized, low pressure application must be used, preferably no more than 100 psi. Applicants have also identified a specific nozzle, (one which delivers a particle size of 750 microns) and application (2 ounces per gallon of a 0.1- to 10 wt. % protein in a concentrated solution, or approximately 5 ppm protein in a use solution) critical for the method as well.

The method is particularly adapted for commercial spraying devices such as those described in US patent publications US2007/0187528 and US2012/0312390, the disclosures of which are hereby expressly incorporated in their entirety by reference. Applicants tested a spraying device with various cleaning/sanitizing formations which included the enzyme lipase to ascertain critical parameters which reduce aerosolization of this protein.

According to the invention, applicant has found that use of the spray nozzle depicted herein with the system dispensed at a rate of 2 oz. per gallon, with a pressure of at least 25 and preferably less than 100 psi, more preferably less than 75 psi solutions with up to 0.003% weight percent of protein in the use solution (or 3 ppm) will be dispensed in a safe manner.

Therefore, it is an object of the present invention to increase cleaning efficiency and safety by utilizing a low-pressure pump to deliver the proper amount of cleaning solution and to prevent the aerosolization of proteins and to provide a fully portable, self-powered unit to aid in the cleaning and sanitation of commercial kitchen and restroom facilities.

The foregoing and other aspects will become apparent from the following detailed description of the invention when considered in conjunction with the accompanying drawing figures.

While multiple embodiments are disclosed, still other embodiments of the present invention will become apparent to those skilled in the art from the following detailed description, which shows and describes illustrative embodiments of the invention. Accordingly, the detailed description and figures are to be regarded as illustrative in nature and not restrictive.

Surprisingly, applicants were able to reduce aerosolization without the need for traditional anti-mist components such as polyethylene oxide, polyacrylamide, polyacrylate and combinations thereof, see for example US publication 20130255729. In a preferred embodiment the methods of the invention employ compositions which are substantially free of anti-mist components, such as polyethylene oxide, polyacrylamide, and polyacrylate.

DETAILED DESCRIPTION OF THE PREFERRED EMBODIMENTS

Figure 1:
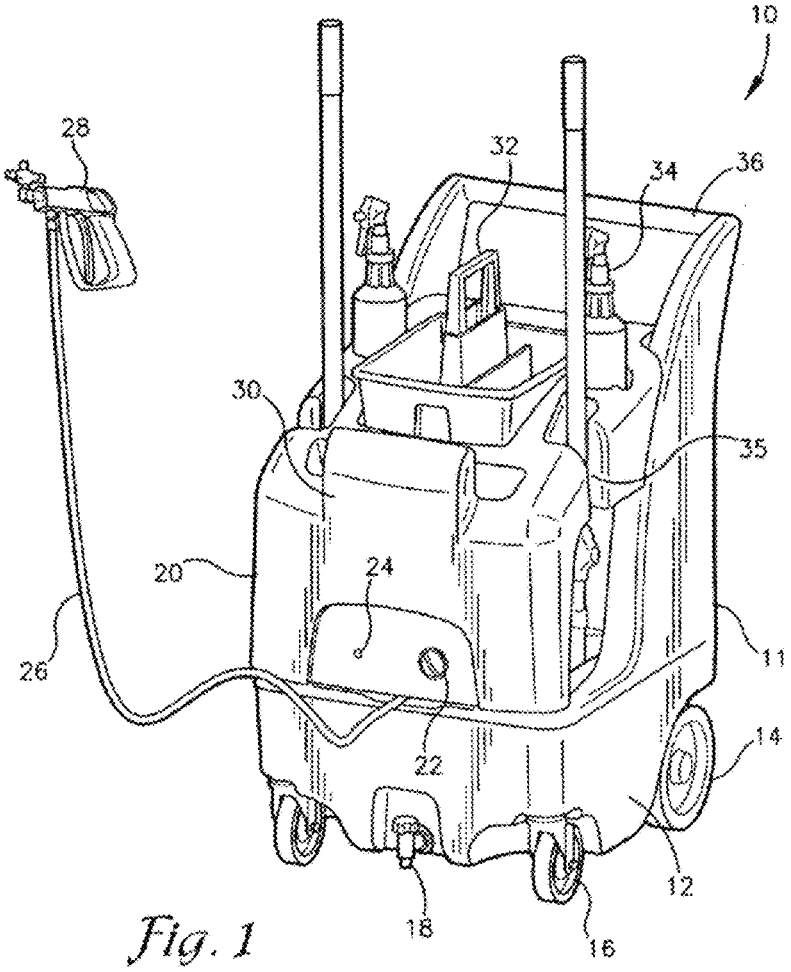
FIG. 1 is a front right side perspective view of an embodiment of a commercial pressurized spray application cleaning apparatus which may be used according to the invention.

Other than in the operating examples, or where otherwise indicated, all numbers expressing quantities of ingredients or reaction conditions used herein are to be understood as being modified in all instances by the term "about".

As used herein, weight percent (wt. %), percent by weight, % by weight, and the like are synonyms that refer to the concentration of a substance as the weight of that substance divided by the total weight of the composition and multiplied by 100.

As used herein, the term "about" modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities.

"Cleansing" means to perform or aid in soil removal, bleaching, microbial population reduction, rinsing, or combination thereof.

It should be noted that, as used in this specification and the appended claims, the singular forms "a", "an", and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleansing expressed as a percentage minus inert ingredients such as water or salts.

As used herein, the term "substantially free" refers to compositions completely lacking the component or having such a small amount of the component that the component does not affect the effectiveness of the composition. The component may be present as an impurity or as a contaminant and shall be less than 0.5 wt. %. In another embodiment, the amount of the component is less than 0.1 wt. % and in yet another embodiment, the amount of component is less than 0.01 wt. %.

Applicants have identified particular methods of application for use in spraying devices employed in commercial cleaning that reduce the mist and aerosolization of proteins present in certain cleaning solutions. Applicants' methods can be used to employ spray wash cleaning systems with chemical formulas including up to 5 wt. %, preferably up to 1.0 wt. % and more preferably up to 0.5 wt. % of protein in a concentrated solution that is diluted to a use solution of 2 ounces per gallon of water. In a use solution applied through a caddy system a 2 ounces per gallon, the amount of protein present that was safely applied was approximately 0.0016% w/w, this is about one half of the acceptable limit of aerosolized enzyme, so at use concentration the invention includes up to 0.003% enzyme or 3 ppm.

According to the invention, low pressure (100 psi or less) commercial carts are used to apply cleaning compositions which include enzymes and other protein or other irritants. The threshold levels during the cycling must be below 60 ng active protein per meters cubed. Applicants have also identified a specific nozzle useful for the method as well. According to the invention, an appropriate spraying nozzle is used to dispense a dilution of a concentrated solution of up to 3 ppm of protein at a rate of 0.5 gallons per minute of use solution. A spraying nozzle that produces an average particle size with a diameter of 1500 microns, such as the Spraying Systems Flat Jet 25 degree angle ¼" MEG 25035 capacity nozzle allow commercial spraying systems to deliver compositions without aerosolization to proteins. For the examples herein, ¼" MEG 25035 nozzle, the nozzle has a ¼ inch inlet diameter for a 25 degree angle of spray at a capacity of 0.35 gallons per minute at 40 psi. This delivers from about 0.3 gpm to about 0.4 gpm. This equates to around 675 microns for a median volume diameter of the spray particles. In general, the higher the pressure and the smaller the orifice of the nozzle, the smaller the particles. The invention is not limited to this specific nozzle, as other nozzles could deliver the same particle size, such as a larger orifice at a higher pressure or a smaller orifice at a lower pressure, and there could be different geometries for the spray rather than the 25 degree flat angle spray. For applying floor cleaners, the application would be from about 0.1 gpm to about 5 gpm.

The methods particularly adapted for spray caddys such as those described in US patent publication US2007/0187528 and US2012/0312390 the disclosures of which are hereby expressly incorporated in their entirety by reference. Applicants tested spray caddys which are not intended or contemplated to be used for application of solutions that include proteins and surprisingly found that upon proper modification of the process, the method can be adapted that allows for use of enzyme containing formulations without their aerosolization.

The invention provides for a means of restroom sanitation which makes the cleaning process faster, more effective and more efficient through reducing overspray and waste by utilizing a low pressure pump to deliver the correct amount of cleaning solution and also so that any enzymes or proteins present in said cleaning solution are not aerosolized. The apparatus can also employ a rechargeable battery, reducing set-up time and allowing the unit to be used in facilities which do not have electrical outlets. Further, the apparatus is equipped with a low pressure spray delivery system which is designed to deliver the proper amount of cleaning solution eliminating over-saturation and waste, saving both water and chemicals, and increasing efficiency by reducing set-up and recovery time. According to the invention, Applicant has found that used of the spray nozzle depicted herein with the system dispensed at a rate of 2 oz. per gallon, with a pressure of 75 psi solutions with up to 0.2 weight percent of protein in the original concentrated solution (diluted to 2 oz. per gallon or up to 3 ppm or 0.003 Wt. % of enzyme will be dispensed in a safe manner.

In a preferred embodiment, a low pressure spray caddy system is employed for the methods of the invention as described below.

Referring now to FIG. 1, an embodiment 10 is shown in front and right side view and presenting a base 11 and a face plate 20. The base 11 of the janitorial cart 10 contains a hollow space in base 11 used as a fresh water reservoir 12.

The rear of the base 11 extends upward along the back of FIG. 1 in a uni-body construction to form a handle 36 and to give overall shape to the handcart 10. Attached to the exterior bottom of the base 11 in the present embodiment are two fixed axle rear wheels 14 and two freely pivoting front wheels 16. The front wheels 16 are allowed to complete 360 degree rotations facilitating better control and steering of the cart. To provide a simple, efficient means for draining the fresh water reservoir b the apparatus 10 has been equipped with a drain spout 18. The drain spout 18 is located on the base 11 below the face plate 20 and between the two front wheels 16.

Figure 3:
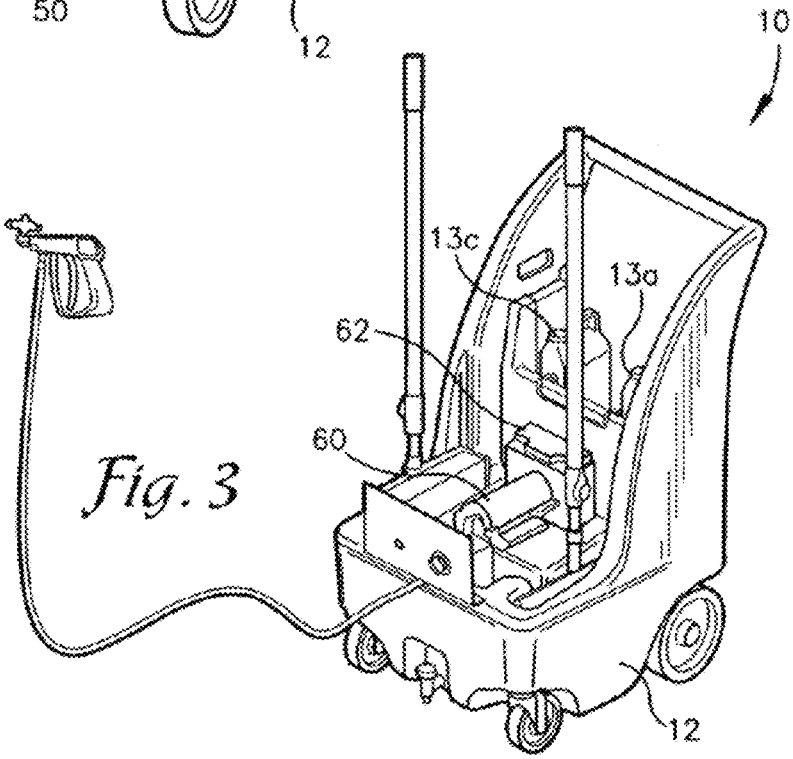
FIG. 3 is a front right side perspective view of the embodiment of FIGS. 1 and 2 with the front face plate and holders removed.

The embodiment 10 contains a removable face plate 20. FIG. 3 shows a view of the apparatus 10 with face plate 20 (FIG. 1) removed. Just below the removable face plate 20 are a chemical selector valve 22 and an on/off power switch 24.

The chemical selector valve 22 allows the user to choose between two readily available chemical products. Once a chemical has been selected using chemical selector valve 22, the embodiment 10 allows for the application of the selected chemical, mixed with water from the fresh water reservoir 12, through the use of hose 26 and the spray gun applicator 28. Such application device consisting of hose 26 and spray gun 28 extending from the front of said device 10 between the base 11 and face plate 20. Spray gun 28 contains two nozzles providing two spray settings allowing user to select between chemical solution or rinse spray applications.

When not in use, hose 26 and spray gun 28 are stored in hose storage space 30 located at the top of face plate 20. Located behind and adjacent to the hose storage 30 at the top of the face plate is the removable tool caddy 32. The tool caddy 32 is removable from the base unit and rests on the top of face plate 20. The tool caddy 32 may be used to carry small items such as towels, rags, dustpans, small tools, brushes, etc.

As it is not always practicable or necessary to use all of the chemical application capabilities of the cart 10, the present embodiment provides for storage and easy access to portable cleaning solution spray bottles for smaller areas of need. Located adjacent to and on either side of the removable tool caddy 32 are two circular storage spaces 34 designed to hold portable spray bottles.

Adjacent to both the tool caddy 32 and the storage space 34 are two handle holders 35 one on either side of the face plate designed to hold the handles of tool such as mops, brushes, brooms, etc., while the heads of such tools rest on the base of FIG. 10 beneath the face plate 20.

Figure 2:
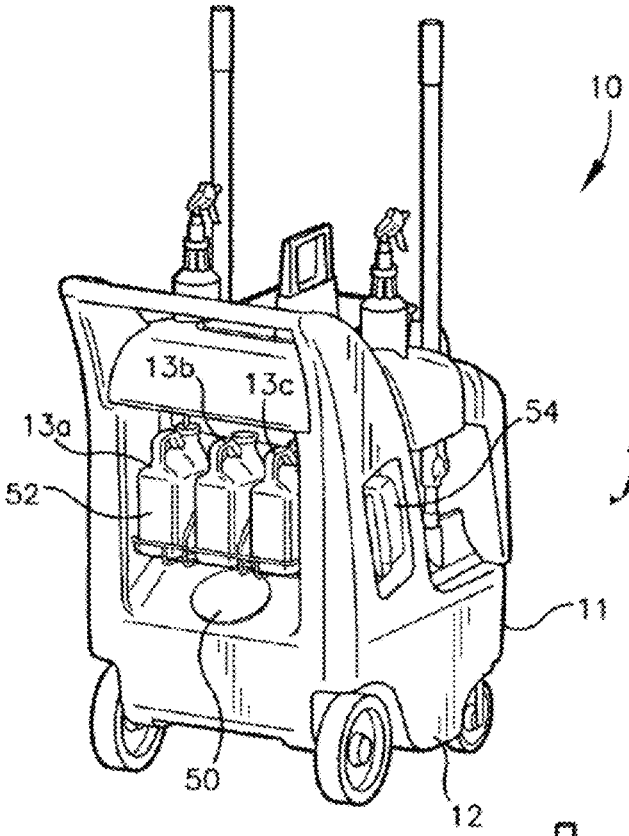
FIG. 2 is rear left side perspective view of the embodiment of FIG. 1.

Referring now to FIG. 2, the embodiment 10 is shown in rear left view. FIG. 2 shows a water fill port 50 on the rear side of the base 11 just below handle 36. The water fill port 50 allows for clean water to be poured into the fresh water reservoir 12. Fresh water is poured through the water fill port 50 and stored in the fresh water reservoir 12 until it is sprayed as rinse water or combined with chemicals from the chemical storage unit 52 and applied through hose 26 and spray gun 28 (FIG. 1).

To increase the efficiency and effectiveness of the user, the present invention allows for the storage and readiness of multiple separate chemical cleaning concentrate materials. Located in the rear of the base 11 just above the water fill port 50 is the chemical storage space 52 containing chemical concentrate containers 13*a,b,c*. Chemicals kept in the chemical storage space 52 remain in their original containers and are connected to the embodiment 10 by removing the shipping cap and seal on each bottle and attaching a chemical feed line to the bottle by screwing the cap on the line to the bottle.

Again referring to FIG. 2, it is of further advantage to increase the efficiency of the user by allowing for the "one touch" choice between multiple separate cleaning solutions 13*a, b, c* by use of selector switch 22. To this end, the embodiment 10 allows for placement of multiple containers of chemical concentrate 13*a,b,c* within the chemical storage space 52. Depending on the size of the chemical containers, chemical storage space 52 also may allow for the transport of additional chemical containers which are not connected for immediate application use. The multiple active chemicals concentrate containers stored in chemical container space 52 are connected through the chemical feed line and may be selected using the chemical selector valve 22 (FIG. 1). Chemicals from the chemical storage area 52 are mixed with fresh water from the fresh water reservoir 12 and ultimately distributed through the hose 26 and the spray gun 28 (FIG. 1).

A primary advantage gained by the present apparatus 10 is the increased mobility and efficiency achieved through the use of a battery 62 (FIG. 3) to power the pump 60 allowing the user to enjoy the great advantage achieved when the unit can be operated without relying on, or connecting to, an external power source.

The battery 62 is recharged through a battery charger 54. In one embodiment the battery charger 54 is accessed and found on the left side of base 11 of the unit 10 (FIG. 2) in the alternative, the battery charter may be positioned within base 11 and out of external view. By plugging the battery charger 54 into an external power source, the battery shown in FIG. 3 can be fully recharged. In the present embodiment 10, the battery charger 54 has two separate rows of lights. The top row indicates the status of the battery. The bottom row of lights indicates the charger's function. The battery charger 54 is permanently connected to the battery 62.

Referring now to FIG. 3 a front and right side view of the apparatus 10 is shown with the face plate 20 removed showing only the base 11 of the unit. Removal of the face plate 20 allows access to the pump 60 and the battery 62. Attached to the base 11 above the fresh water reservoir 12 is the pump 60. At the rear of the pump 60 is the battery 62 which, provides power to the pump.

Again referring to FIG. 3, the pump 60 provides pressure which expels combination of water from the fresh water reservoir 12 and chemicals from the chemical source containers 52 (FIG. 1). The specially calibrated pump provides a low pressure and low volume flow rate and delivers the proper amount or proper dilution of solution while eliminating over saturation with chemicals and waste of water, chemicals. In a preferred embodiment, chemical application pressure created by the pump 60 and distributed through the hose 26 (FIG. 1) and spray gun 28 (FIG. 1) is about 65-75 PSI, while the pump flow rate is ½ gallon per minute. During rinsing applications the application pressure created by the pump 60 is about 100-120 PSI. The efficiency advantage provided by the low flow rate is enhanced in the present embodiment by the high capacity of the fresh water reservoir 12. The low pressure pump 60 and the fresh water reservoir 12 combine to provide up to 28 minutes of run time without stopping to refill. The low application and rinse pressure avoids the problems created by higher pressure applicators which, as previously described, can force solutions and water into cracks and behind tile work an result in mold, mildew and the destruction of the connection between the tile work and the floor or wall of the building. As stated, the low pressure and low volume of a preferred embodiment produces a flow rate of about ½ gallon per minute which is about half the volume of prior art devices. And this flow rate is achieved at about ⅓ the deliver pressure of the solution against the building surfaces thus protecting the structure from mold, mildew and tile damage. A further benefit is achieved by the low pressure and low volume operation as the same amount of cleaning and same amount of operator time is involved with the low pressure and low volume device while reducing the waste of materials and need to clean up only one half of the applied chemical and/or rinse water while achieving the same cleaning benefit.

As previously mentioned, the present embodiment operates more quietly as it does not include any type of vacuum pick-up device as do many prior art devices. As a result of this change and by use of the low pressure/low volume pump, the present embodiment operates at just over 65 decibels—or about the same volume of sound as a typical conversation—therefore making the present embodiment suitable for use in "quite zone" areas such as schools and hospitals.

In one embodiment the dilution of the chemical concentrate is controlled by the use of specifically sized draw tubes or straws contained within the bottles of chemical concentrate. In this manner the user is not confronted by the need to calculate dilutions or to modify valves or change flow rates to accommodate the different chemicals used with the apparatus 10. Such bottles of chemical concentrate, having specifically sized draw tubes or straws contained within the bottles are known within the art as "F-type" bottles.

Figure 4:
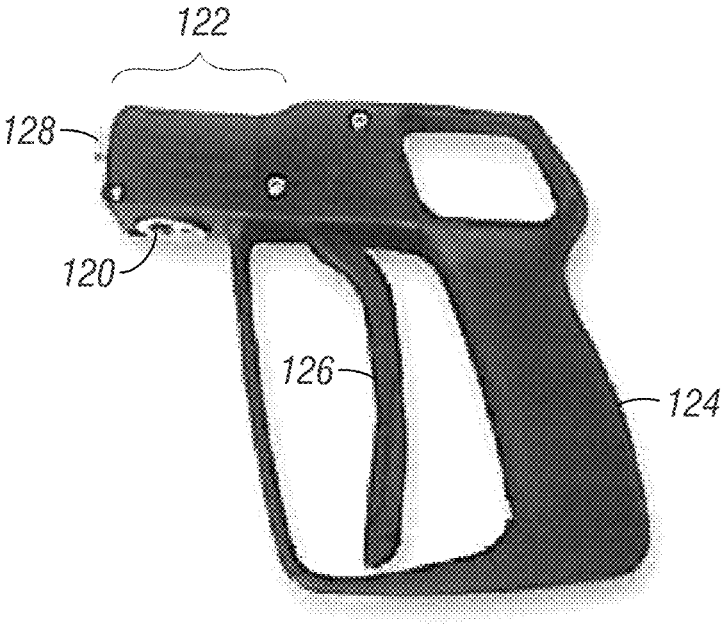
FIG. 4 is a non-limiting diagrammatic representation of a typical spray gun that may be used in the method of the invention.

Referring now to FIG. 4, a typical spray gun 28, is depicted which may be used with the invention. Hose inlet 120 attaches to the spray gun at the frontal barrel section 122, away from handle 124 and trigger mechanism 126. Outlet spray nozzle receptacle 128 is at the end of the barrel to which a particular spray nozzle of desired size and flow rate is attached.

Figure 5:
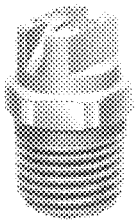
FIG. 5 is a non-limiting diagrammatic representation of a typical spray nozzle for attachment to the spray gun depicted in FIG. 4 and used in the Examples.

FIG. 5 is a typical nozzle attachment including a female body 140, a male body 142, a screen strainer 144, a spray tip of desired size and flow rate 146, and a tip retainer 148 which are removable attached to the outlet spray nozzle receptacle.

The invention is not limited to this particular caddy delivery system as any pressure spray delivery system which delivers spray at less than 75 psi and in accordance with the other parameters disclosed herein would be expected to have similar results.

Chemical Compositions Employing Proteins

Proteins such as enzymes form an important part of many cleaning compositions including bath room sanitizers, floor cleaners and other hard surface cleaners. Any chemical solution which employs protein may be used as long as properly diluted in a use/application solution of up to 5 ppm protein may be safely applied according to the invention.

Enzymes provide desirable activity for removal of protein-based, carbohydrate-based, or triglyceride-based stains from substrates; for cleaning, destaining, and sanitizing hard surface cleaners. Enzymes may act by degrading or altering one or more types of soil residues encountered on a surface or textile thus removing the soil or making the soil more removable by a surfactant or other component of the cleaning composition. Both degradation and alteration of soil residues can improve detergency by reducing the physicochemical forces which bind the soil to the surface being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes may include a protease, an amylase, a lipase, a gluconase, a cellulase, a peroxidase, or a mixture thereof of any suitable origin, such as vegetable, animal, bacterial, fungal or yeast origin. Selections are influenced by factors such as pH-activity and/or stability optima, thermostability, and stability to active detergents, builders and the like. In this respect bacterial or fungal enzymes may be preferred, such as bacterial amylases and proteases, and fungal cellulases. Preferably the enzyme may be a protease, a lipase, an amylase, or a combination thereof. Enzyme may be present in the applied use solution of up to 5 ppm. In a typical concentrate applied at 2 oz/gallon, the concentration could include from at least 0.01 wt. %, to 8 wt. %, preferably from about 0.05 wt. % to about 5 wt. % and more preferably from about 0.1 wt. % to about 3 wt. %.

Often the chemical cleaning compositions for use in the methods of the invention will an enzyme stabilizing system. The enzyme stabilizing system can include a boric acid salt, such as an alkali metal borate or amine (e.g. an alkanolamine) borate, or an alkali metal borate, a borate ester, or potassium borate. The enzyme stabilizing system can also include other ingredients to stabilize certain enzymes or to enhance or maintain the effect of the boric acid salt. For example, the cleaning composition for application according to the invention can include a water soluble source of calcium and/or magnesium ions.

Enzyme stabilizing components may be present in an amount as needed to stabilize any enzymes present, but typically will be present in an amount of from about 0.1 wt. % to about 15 wt. % preferably from about 0.5 wt. % to about 10 wt. % more preferably from about 1 wt. % to about 8 wt. %.

Typical components in such hard surface cleaners include but are not limited to builders, solvents, surfactants (anionic surfactants, nonionic surfactants, semi-polar nonionic surfactants, cationic surfactants, amphoteric surfactants), pH adjusting agents, hydrotopes, defoaming agents, stabilizing agents, chelating/sequestering agents, bleaching agents, anti-redeposition agents, dyes/odorants, divalent ion, polyol, fragrances and/or thickening agents.

The following is a non-limiting description of examples of components invention in addition to protein that may be present in hard surface cleaning compositions that can be applied according to the.

Surfactants

The aqueous cleaning sprayable composition includes a surfactant. A variety of surfactants may be used, including anionic, nonionic, cationic, and amphoteric surfactants. Example suitable anionic materials are surfactants containing a large lipophilic moiety and a strong anionic group. Such anionic surfactants contain typically anionic groups selected from the group consisting of sulfonic, sulfuric or phosphoric, phosphonic or carboxylic acid groups which when neutralized will yield sulfonate, sulfate, phosphonate, or carboxylate with a cation thereof preferably being selected from the group consisting of an alkali metal, ammonium, alkanol amine such as sodium, ammonium or triethanol amine. Examples of operative anionic sulfonate or sulfate surfactants include alkylbenzene sulfonates, sodium xylene sulfonates, sodium dodecylbenzene sulfonates, sodium linear tridecylbenzene sulfonates, potassium octyldecylbenzene sulfonates, sodium lauryl sulfate, sodium palmityl sulfate, sodium cocoalkyl sulfate, sodium olefin sulfonate.

Nonionic surfactants carry no discrete charge when dissolved in aqueous media. Hydrophilicity of the nonionic is provided by hydrogen bonding with water molecules. Such nonionic surfactants typically comprise molecules containing large segments of a polyoxyethylene group in conjunction with a hydrophobic moiety or a compound comprising a polyoxypropylene and polyoxyethylene segment. Polyoxyethylene surfactants are commonly manufactured through base catalyzed ethoxylation of aliphatic alcohols, alkyl phenols and fatty acids. Polyoxyethylene block copolymers typically comprise molecules having large segments of ethylene oxide coupled with large segments of propylene oxide. These nonionic surfactants are well known for use in this art area. Additional example nonionic surfactants include alkyl polyglycosides.

The lipophilic moieties and cationic groups comprising amino or quaternary nitrogen groups can also provide surfactant properties to molecules. As the name implies to cationic surfactants, the hydrophilic moiety of the nitrogen bears a positive charge when dissolved in aqueous media. The soluble surfactant molecule can have its solubility or other surfactant properties enhanced using low molecular weight alkyl groups or hydroxy alkyl groups.

The cleaning composition can contain a cationic surfactant component that includes a detersive amount of cationic surfactant or a mixture of cationic surfactants. The cationic surfactant can be used to provide sanitizing properties. In one example, cationic surfactants can be used in basic compositions.

Cationic surfactants that can be used in the cleaning composition include, but are not limited to: amines such as primary, secondary and tertiary monoamines with alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium compounds and salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, a naphthylene-substituted quaternary ammonium chloride such as dimethyl-1-naphthylmethylammonium chloride.

Amphoteric surfactants can also be used. Amphoteric surfactants contain both an acidic and a basic hydrophilic moiety in the structure. These ionic functions may be any of the anionic or cationic groups that have just been described previously in the sections relating to anionic or cationic surfactants. Briefly, anionic groups include carboxylate, sulfate, sulfonate, phosphonate, etc. while the cationic groups typically comprise compounds having amine nitrogens. Many amphoteric surfactants also contain ether oxides or hydroxyl groups that strengthen their hydrophilic tendency. Preferred amphoteric surfactants of this invention comprise surfactants that have a cationic amino group combined with an anionic carboxylate or sulfonate group. Examples of useful amphoteric surfactants include the sulfobetaines, N-coco-3,3-aminopropionic acid and its sodium salt, n-tallow-3-amino-dipropionate disodium salt, 1,1-bis (carboxymethyl)-2-undecyl-2-imidazolinium hydroxide disodium salt, cocoaminobutyric acid, cocoaminopropionic acid, cocoamidocarboxy glycinate, cocobetaine. Suitable amphoteric surfactants include cocoamidopropylbetaine, polyether siloxane, and cocoaminoethylbetaine.

Amine oxides, such as tertiary amine oxides, may also be used as surfactants. Tertiary amine oxide surfactants typically comprise three alkyl groups attached to an amine oxide (N→O). Commonly the alkyl groups comprise two lower ($C_{1-4}$)alkyl groups combined with one higher $C_{6-24}$ alkyl groups, or can comprise two higher alkyl groups combined with one lower alkyl group. Further, the lower alkyl groups can comprise alkyl groups substituted with hydrophilic moiety such as hydroxyl, amine groups, carboxylic groups, etc. Suitable amine oxide materials include dimethylcetylamine oxide, dimethyllaurylamine oxide, dimethylmyristylamine oxide, dimethylstearylamine oxide, dimethylcocoamine oxide, dimethyldecylamine oxide, and mixtures thereof. The classification of amine oxide materials may depend on the pH of the solution. On the acid side, amine oxide materials protonate and can simulate cationic surfactant characteristics. At neutral pH, amine oxide materials are non-ionic surfactants and on the alkaline side, they exhibit anionic characteristics.

Another important class of surfactants include functionalized alkyl polyglucosides which can fall into any class of surfactants depending on the functional groups (nonionic, anionic, amphoteric etc.). One example includes the "green" series of surfactants based on the renewable resource of alkyl polyglucosides, available from Colonial Chemical. These include alkyl polyglucoside derivatives with various functional groups such as sulfonated and polysulfonated alkyl polyglucoside derivatives, phosphate and polyphosphate alkyl polyglucoside derivatives, quaternary functionalized alkyl polyglucoside derivatives, polyquaternary functionalized alkyl polyglucoside derivatives, betaine functionalized alkyl polyglucoside derivatives, sulfosuccinate functionalized alkyl polyglucoside derivatives, and the like.

The surfactant is present in the composition in an amount of from about 1 wt. % to about 60 wt. % from about 5 wt. % to about 55 wt. % and from about 10 wt. % to about 50 wt. %.

Builder

Useful detergency builders in liquid compositions include the alkali metal silicates, alkali metal carbonates, polyphosphonic acids, $C_{10}$-$C_{18}$ alkyl monocarboxylic acids, polycarboxylic acids, alkali metal, ammonium or substituted ammonium salts thereof, and mixtures thereof.

The builder is preferably present in the composition in an amount from about 0 to about 8 wt. %, from about 0.01 to about 5 wt. %, and from about 0.5 to about 2 wt. %.

pH-Adjusting Compound

Compositions of the present invention have a pH of about 4.0 to about 8. Within this pH range, the present compositions effectively reduce microbial populations, and are consumer acceptable, i.e., are mild to the skin, are phase stable, and generate copious, stable foam. In some instances a pH adjusting compound may be necessary in a sufficient amount to provide a desired composition pH. To achieve the full advantage of the present invention, the pH-adjusting compound is present in an amount of about 0.05% to about 3.5%, by weight.

Examples of basic pH-adjusting compounds include, but are not limited to, ammonia; mono-, di-, and trialkyl amines; mono-, di-, and trialkanolamines; alkali metal and alkaline earth metal hydroxides; alkali metal phosphates; alkali sulfates; alkali metal carbonates; and mixtures thereof. However, the identity of the basic pH adjuster is not limited, and any basic pH-adjusting compound known in the art can be used. Specific, nonlimiting examples of basic pH-adjusting compounds are ammonia; sodium, potassium, and lithium hydroxide; sodium and potassium phosphates, including hydrogen and dihydrogen phosphates; sodium and potassium carbonate and bicarbonate; sodium and potassium sulfate and bisulfate; monoethanolamine; trimethylamine; isopropanolamine; diethanolamine; and triethanolamine.

The identity of an acidic pH-adjusting compound is not limited and any acidic pH-adjusting compound known in the art, alone or in combination, can be used. Examples of specific acidic pH-adjusting compounds are the mineral acids and polycarboxylic acids. Nonlimiting examples of mineral acids are hydrochloric acid, nitric acid, phosphoric acid, and sulfuric acid. Nonlimiting examples of polycarboxylic acids are citric acid, glycolic acid, and lactic acid. The pH adjusting agent is present as needed but is generally present in the composition in an amount from about 0 to about 5 wt. %, from about 0.01 to about 3 wt. %, and from about 0.5 to about 2 wt. %.

Solvent

A solvent is often times useful in cleaning compositions to enhance soil removal properties. The cleaning compositions of the invention may include a solvent to adjust the viscosity of the final composition. The intended final use of the composition may determine whether or not a solvent is included in the cleaning composition. If a solvent is included in the cleaning composition, it is usually a low cost solvent such as isopropyl alcohol. A solvent may or may not be included to improve soil removal, handle ability or ease of use of the compositions of the invention. Suitable solvents useful in removing hydrophobic soils include, but are not limited to: oxygenated solvents such as lower alkanols, lower alkyl ethers, glycols, aryl glycol ethers and lower alkyl glycol ethers. Examples of other solvents include, but are not limited to: methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include, not are not limited to: propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether and the like.

The solvent is preferably present in the composition in an amount from about 0.1 to about 18 wt. %, from about 0.5 to about 10 wt. %, and from about 1 to about 8 wt. %.

Defoaming Agents

A minor but effective amount of a defoaming agent for reducing the stability of foam may also be included in the compositions. The cleaning composition can include 0.01-5 wt. % of a defoaming agent, or 0.01-3 wt. %.

Examples of defoaming agents include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein. The defoaming agent is preferably present in the composition in an amount from about 0 to about 5 wt. %, from about 0.01 to about 3 wt. %, and from about 0.05 to about 2 wt. %.

Water Conditioning Agent

The water conditioning agent aids in removing metal compounds and in reducing harmful effects of hardness components in service water. Exemplary water conditioning agents include chelating agents, sequestering agents and inhibitors. Polyvalent metal cations or compounds such as a calcium, a magnesium, an iron, a manganese, a molybdenum, etc. cation or compound, or mixtures thereof, can be present in service water and in complex soils. Such compounds or cations can interfere with the effectiveness of a washing or rinsing compositions during a cleaning application. A water conditioning agent can effectively complex and remove such compounds or cations from soiled surfaces and can reduce or eliminate the inappropriate interaction with active ingredients including the nonionic surfactants and anionic surfactants of the invention. Both organic and inorganic water conditioning agents are common and can be used. Inorganic water conditioning agents include such compounds as sodium tripolyphosphate and other higher linear and cyclic polyphosphates species. Organic water conditioning agents include both polymeric and small molecule water conditioning agents. Organic small molecule water conditioning agents are typically organocarboxylate compounds or organophosphate water conditioning agents. Polymeric inhibitors commonly comprise polyanionic compositions such as polyacrylic acid compounds. Small molecule organic water conditioning agents include, but are not limited to: sodium gluconate, sodium glucoheptonate, N-hydroxyethylenediaminetriacetic acid (HEDTA), ethylenediaminetetraacetic acid (EDTA), nitrilotriacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). All of these are known and commercially available. The defoaming agent is preferably present in the composition in an amount from about 0 to about 15 wt. %, from about 0.01 to about 10 wt. %, and from about 0.05 to about 5 wt. %.

Hydrotropes

The compositions of the invention may optionally include a hydrotrope that aides in compositional stability and aqueous formulation. Functionally speaking, the suitable hydrotrope couplers which can be employed are non-toxic and retain the active ingredients in aqueous solution throughout the temperature range and concentration to which a concentrate or any use solution is exposed.

Any hydrotrope coupler may be used provided it does not react with the other components of the composition or negatively affect the performance properties of the composition. Representative classes of hydrotropic coupling agents or solubilizers which can be employed include anionic surfactants such as alkyl sulfates and alkane sulfonates, linear alkyl benzene or naphthalene sulfonates, secondary alkane sulfonates, alkyl ether sulfates or sulfonates, alkyl phosphates or phosphonates, dialkyl sulfosuccinic acid esters, sugar esters (e.g., sorbitan esters), amine oxides (mono-, di-, or tri-alkyl) and $C_8$-$C_{10}$ alkyl glucosides. Preferred coupling agents for use in the present invention include n-octanesulfonate, available as NAS 8D from Ecolab Inc., n-octyl dimethylamine oxide, and the commonly available aromatic sulfonates such as the alkyl benzene sulfonates (e.g. xylene sulfonates) or naphthalene sulfonates, aryl or alkaryl phosphate esters or their alkoxylated analogues having 1 to about 40 ethylene, propylene or butylene oxide units or mixtures thereof. Other preferred hydrotropes include nonionic surfactants of $C_6$-$C_{24}$ alcohol alkoxylates (alkoxylate means ethoxylates, propoxylates, butoxylates, and co-or-terpolymer mixtures thereof) (preferably $C_6$-$C_{14}$ alcohol alkoxylates) having 1 to about 15 alkylene oxide groups (preferably about 4 to about 10 alkylene oxide groups); $C_6$-$C_{24}$ alkylphenol alkoxylates (preferably $C_8$-$C_{10}$ alkylphenol alkoxylates) having 1 to about 15 alkylene oxide groups (preferably about 4 to about 10 alkylene oxide groups); $C_6$-$C_{24}$ alkylpolyglycosides (preferably $C_6$-$C_{20}$ alkylpolyglycosides) having 1 to about 15 glycoside groups (preferably about 4 to about 10 glycoside groups); $C_6$-$C_{24}$ fatty acid ester ethoxylates, propoxylates or glycerides; and $C_4$-$C_{12}$ mono or dialkanolamides. A preferred hydrotope is sodium xylenesulfonate (SXS).

The composition of an optional hydrotrope can be present in the range of from about 0 to about 25 percent by weight.

Carrier

The cleaning composition also includes water as a carrier. It should be appreciated that the water may be provided as deionized water or as softened water. The water provided as part of the concentrate can be relatively free of hardness. It is expected that the water can be deionized to remove a portion of the dissolved solids. That is, the concentrate can be formulated with water that includes dissolved solids, and can be formulated with water that can be characterized as hard water. The compositions can include in a concentrate from about 40 wt. % to about 90 wt. % water, from about 45 wt. % to about 85 wt. % and from about 50 wt. % to about 80 wt. %.

Compositions that include protein are typically hard surface cleaning or disinfecting compositions are designed for a spray and leave or spray and wipe mode of application.

In such an applications, the user generally applies an effective amount of the composition using the pump and within a few moments thereafter, wipes off the treated area with a cloth, towel, or sponge, usually a disposable paper towel or sponge. In certain applications, however, especially where undesirable stain deposits are heavy, such as grease stains the cleaning composition according to the invention may be left on the stained area until it has effectively loosened the stain deposits after which it may then be wiped off, rinsed off, or otherwise removed. For particularly heavy deposits of such undesired stains, multiple applications may also be used. Optionally, after the composition has remained on the surface for a period of time, it could be rinsed or wiped from the surface. Due to the viscoelasticity of the compositions, the cleaning compositions have improved cling and remain for extended periods of time even on vertical surfaces.

Whereas the compositions for use of the methods of the invention are often discussed and exemplified in concentrated types of liquid forms described, nothing in this specification shall be understood as to limit the use of the composition according to the invention with a further amount of water to form a cleaning use solution there from. In such a proposed diluted cleaning solution, the greater the proportion of water added to form said cleaning dilution will, the greater may be the reduction of the rate and/or efficacy of the thus formed cleaning solution. Accordingly, longer residence times upon the stain to affect their loosening and/or the usage of greater amounts may be necessitated. Preferred dilution ratios of the concentrated hard surface cleaning composition:water of 1:1-200, preferably 1:2-100, more preferably 1:3-100, yet more preferably 1:10-100, and most preferably 1:16-85, on either a weight/weight ("w/w") ratio or alternately on a volume/volume ("v/v") ratio.

Conversely, nothing in the specification shall be also understood to limit the forming of a "super-concentrated" cleaning composition based upon the composition described above. Such a super-concentrated ingredient composition is essentially the same as the cleaning compositions described above except in that they include a lesser amount of water.

Typical Floor No-Rinse Cleaning Composition

By way of example, a typical protein containing no-rinse floor cleaner composition to be used in the method of the invention is below:

Typical No-Rinse Floor Cleaner

| | 1st range wt. % | 2nd range wt. % | 3rd range wt. % |
|---|---|---|---|
| Water | 40-90 | 45-85 | 50-80 |
| pH neutralizing agent | 0-5 | 0.01-3 | 0.5-2 |
| surfactants | 1-60 | 5-55 | 10-50 |
| enzyme stabilizer | 0.1-15 | 0.5-10 | 1-8 |
| solvent | 0.1-18 | 0.5-10 | 1-8 |
| hydrotope | 0.1-20 | 0.5-15 | 1-10 |
| water conditioning agent | 0-15 | 0.01-10 | 0.05-5 |
| protein | 0.01-8 | 0.05-5 | 0.1-3 |
| Dye and fragrance | 0-1 | 0-0.5 | 0-0.3 |

Typical Sanitizing No Rinse Floor Cleaner composition

| | 1st range wt. % | 2nd range wt. % | 3rd range wt. % |
|---|---|---|---|
| Water | 40-90 | 45-85 | 50-80 |
| solvent | 0.1-18 | 0.5-10 | 1-8 |
| pH neutralizing agent | 0- | 0.01-3 | 0.5-2 |
| surfactants | 1-60 | 5-55 | 10-50 |
| water conditioning agent | 0-15 | 0.01-10 | 0.05-5 |
| enzyme stabilizer | 0.1-15 | 0.5-10 | 1-8 |
| protein | .01-8 | 0.05-5 | 0.1-3 |
| Dye and fragrance | 0-1 | 0-0.5 | 0-0.3 |

Methods Employing Compositions

Again referring to FIG. 3, the pump 60 provides pressure which expels combination of water from the fresh water reservoir 12 and chemicals from the chemical source containers 52 (FIG. 1). The specially calibrated pump provides a low pressure and low volume flow rate and delivers the proper amount or proper dilution of solution while eliminating over saturation with chemicals and waste of water, chemicals. In a preferred embodiment, chemical application pressure created by the pump 60 and distributed through the hose 26 (FIG. 1) and spray gun 28 (FIG. 1) is about 65-75 PSI, preferably at 75 PSI and no higher while the pump flow rate is ½ gallon per minute. During rinsing applications the application pressure created by the pump 60 is about 100-120 PSI. The efficiency advantage provided by the low flow rate is enhanced in the present embodiment by the high capacity of the fresh water reservoir 12. The low pressure pump 60 and the fresh water reservoir 12 combine to provide up to 28 minutes of run time without stopping to refill. Any means may be used to apply the compositions provided the critical dilution, pressure rate and particle size are achieved. This can include a garden hose end sprayer, for example.

The low application pressure avoids the problems created by higher application pressure which, as previously described, is one of the factors that prevents the proteins from becoming aerosolized and thus improves safety. Higher pressure can also cause additional problems as it can force solutions and water into cracks and behind tile work and result in mold, mildew and the destruction of the connection between the tile work and the floor or wall of the building. As stated, the low pressure and low volume of a preferred embodiment produces a flow rate of about ½ gallon per minute which is about half the flow rate of prior art devices. This flow rate is achieved at about ⅓ the application pressure of the solution against the building surfaces thus protecting the user from aerosolization of proteins.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques. Formulations were prepared according to the tables below:

Standard No-Rinse Floor Cleaner

| | 1st range wt. % | 2nd range wt. % | 3rd range wt. % |
|---|---|---|---|
| Water | 40-90 | 45-85 | 50-80 |
| pH neutralizing agent | 0-5 | 0.01-3 | 0.5-2 |
| surfactants | 1-60 | 5-55 | 10-50 |
| enzyme stabilizer | 0.1-15 | 0.5-10 | 1-8 |
| solvent | 0.1-18 | 0.5-10 | 1-8 |
| hydrotrope | 0.1-20 | 0.5-15 | 1-10 |
| water conditioning agent | 0-15 | 0.01-10 | 0.05-5 |
| protein | 0.01-8 | 0.05-5 | 0.1-3 |
| Dye and fragrance | 0-1 | 0-0.5 | 0-0.3 |

Sanitizing Floor Cleaner

| | 1st range wt. % | 2nd range wt. % | 3rd range wt. % |
|---|---|---|---|
| Water | 40-90 | 45-85 | 50-80 |
| solvent | 0.1-18 | 0.5-10 | 1-8 |
| pH neutralizing agent | 0-5 | 0.01-3 | 0.5-2 |
| surfactants | 1-60 | 5-55 | 10-50 |
| water conditioning agent | 0-15 | 0.01-10 | 0.05-5 |
| enzyme stabilizer | 0.1-15 | 0.5-10 | 1-8 |
| protein | .01-8 | 0.05-5 | 0.1-3 |
| Dye and fragrance | 0-1 | 0-0.5 | 0-0.3 |

Anti-mist floor cleaner

| | 1st range wt. % | 2nd range wt. % | 3rd range wt. % |
|---|---|---|---|
| Water | 40-90 | 45-85 | 50-80 |
| surfactant | 0.1-25 | 0.5-20 | 1-15 |
| pH neutralizing agent | 0-5 | 0.01-3 | 0.5-2 |
| solvent | 0.1-18 | 0.5-10 | 1-8 |
| hydrotrope | 0.1-15 | 0.5-10 | 1-8 |
| Anti-mist agent | 0.01-8 | 0.05-5 | 0.1-3 |
| protein | 0.01-8 | 0.05-5 | 0.1-3 |
| Dye and fragrance | 0-1 | 0-0.5 | 0-0.3 |

The anti-mist agent is Polyox WSR-301 from Dow chemical (high molecular weight poly(ethylene oxide) polymer).

Twice the amount of solvent was used in the Anti-mist floor cleaner Formula in order to keep the polyox stable and in solution. Different metering tips were evaluated to achieve the desired dilution due to the anti-mist formula being thicker and more difficult to dispense.

Example 1

Anti-Mist Floor Cleaner Metering Tip Determination for the Caddy Test

Purpose

The designated values attributed to the metering tips are guaranteed only with water thin products. The standard and sanitizing no-rinse floor cleaners were based on the metering tips chart as they were water thin. This test was done to determine which metering tip is appropriate for dispensing 2 oz/gal of the anti-mist enhanced cleaning solutions.

Metering Tips

The following chart is to be used as a guide. The list shows orifices in ascending order from smallest (Brown) to largest (Black).

| | |
|---|---|
| 0.56 oz/min | Brown |
| 0.88 oz/min | Clear |
| 1.38 oz/min | Bright Purple |
| 2.15 oz/min | White |
| 2.93 oz/min | Pink |
| 3.84 oz/min | Corn Yellow |
| 4.88 oz/min | Dark Green |
| 5.77 oz/min | Orange |
| 6.01 oz/min | Gray |
| 7.01 oz/min | Light Green |
| 8.06 oz/min | Med. Green |
| 9.43 oz/min | Clear Pink |
| 11.50 oz/min | Yellow Green |
| 11.93 oz/min | Burgundy |
| 13.87 oz/min | Pale Pink |
| 15.14 oz/min | Light Blue |
| 17.88 oz/min | Dark Purple |
| 25.36 oz/min | Navy Blue |

-continued

| | |
|---|---|
| 28.60 oz/min | Clear Aqua |
| 50.00 oz/min | Black |

Procedure

1) Samples prepared a day before testing to ensure fresh polyox
2) RMs added with mixing in order as they appear in formulas above except for the polyox enhanced solution. Polyox was premixed with propylene glycol and added at the end.
3) No enzymes were included in the test
4) After polyox is added, solution was set on a stir plate and mixed for ~1 hr at 200 rpm till polyox completely went into solution.
5) Day of the test polyox is added to bags specific to the caddy.
6) Solution bag placed in caddy and primed through sprayer so that solution runs through all the tubing.
7) Solution bag removed from caddy, weighed, and placed back on caddy. Solution sprayed for 1:30 into a collection tub.
8) Solution bag removed and reweighed to calculate amount of solution used. Tub is weighed to calculate amount of solution dispensed.
9) A percentage of concentrate to RTU dispensed is calculated to give a concentration percentage and compared to 2 oz/gal (1.56%).
10) Metering tips are swapped out multiple times to determine which will give us the desired 1.56% concentration of polyox enhanced solution dispensed.

Data

The goal of the testing is to find a metering tip that is able to dispense the Polyox concentrate at 1.56% (2 oz/gal). The metering tip for the anti-mist formula was determined using the standard spray nozzle. The below data is from testing the Polyox concentrate only.

| Internal Caddy | | |
|---|---|---|
| Metering Tip | Hole Diameter | Conc. % |
| Purple | 0.014 | 0.004 |
| Tan | 0.035 | 0.034 |
| Brown | 0.23 | 1.67 |
| Orange | 0.25 | 1.9 |
| Green | 0.28 | 2.3 |

The appropriate tip according to the results we found in our testing for the polyox concentrate will be the brown metering tip using the standard sprayer.

Example 2

Experiments were undertaken to attempt to reduce aerosolization of proteins from solution applied in commercial cleaning caddy systems. The cleaning caddy has a spray device, which is used for applying various non-enzymatic cleaning products to hard surfaces, that sprays at an average pressure of 70 psi. In this assessment the enzymatic cleaning product is mixed with water at a ratio of 2 oz/gal (15.6 ml/l) before being sprayed on tile floor at a flow rate of ½ gallon/min (1.9 l/min). The undiluted product contains 1% Lipex 100L (Novozymes).

An experiment was undertaken to evaluate the amounts of aerosolized enzymes that the person operating the cleaning caddy will be exposed to.

The experiment was performed during use of a commercial caddy system as described herein product and three formulations, a standard no-rinse formulation, a sanitizing cleaning composition and an anti-mist formulation. These formulations have been applied using the existing spray device. All product formulations are liquid and contain Lipex 100 L at 1% (v/v). The cleaning caddy has a built in wet vacuum machine. The exposure has been assessed during removal of the product using this wet vacuuming machine as well as by using squeegee. The assessment is focused on determining the peak exposure generated by each application but also an average monitoring over the whole cleaning cycle has been determined.

Final Overall Results

The results are summarized in Table 1

TABLE 1

Lipex exposure during all handling and cleaning processes relevant for three different Caddy formulations. All exposure data are given as: ng active enzyme protein/$m^3$ air.

| Formulation | Distribution mode | Exposure: Distribution | Exposure: Brushing | Exposure: Wet vacuum machine | Exposure: Squeegee | Exposure: Whole cycle |
|---|---|---|---|---|---|---|
| Standard | Spray | 24.5 | <1.42 | <1.42 | — | 9.8 |
| Sanitizing | Spray | 27.9 | <1.42 | — | <1.42 | 14.5 |
| Antimist | Spray | 31.0 | <1.42 | <1.42 | — | 7.7 |

Enzyme Exposure Sampling

Enzyme exposure assessment was performed on these different combinations:

1. Commercial spray caddy cleaning formulation being sprayed, followed by scrubbing with a stiff bristle brush and removed by wet vacuuming.
2. Commercial sanitizing spray caddy cleaning formulation being sprayed, followed by scrubbing with a stiff bristle brush and removed by squeegeeing
3. Commercial anti-mist spray caddy formulation being sprayed, followed by scrubbing with a stiff bristle brush and removed by wet vacuuming.

To determine if there is any exposure from the exhaust of the vacuuming machine additional air samplings were performed close to the exhaust pipe.

During the assessment two Gillian Aircon pumps were used to determine the exposure from the whole cleaning cycle and two were used to assess each individual application, i.e. spraying, scrubbing, squeegeeing or wet vacuuming. To keep the filters around one meter of the breathing zone of the operator throughout the whole monitoring time they were mounted on two trolleys which were kept at each side of the operator. The filters were positioned 150 cm above the floor. To avoid biased results each caddie had one pump sampling the whole cycle and one pump sampling for the individual process, on the caddies the left pump was sampling throughout the whole cycle and the right was sampling during the individual application.

Each enzyme exposure sampling was performed according to the following procedure:

| Time | |
|---|---|
| 0 minutes | Pumps are started |
| After 1 minute | Start the cleaning procedure, e.g. spraying or brushing |
| After 9 minutes | Stop the cleaning procedure (total 8 min) |
| After 11 minutes | Turn off the pump |

Materials & Methods

Air Sampling

Four Gillian AirCon pumps were used.

All air samplings were performed with the air flow 25 liters per minute within one meter of the operators breathing zone. The sampling time was recorded and the filters stored at −20° C. until analysis.

Samples 38 air filters were collected, stored, and frozen until analyzed.

Filter Samples

Filters were eluted during stirring in 5 mL PBS/BSA/Brij (Phosphate 0.01 M/BSA 0.5%/Brij 0.023% (surface active ingredient) buffer pH 7.4 for 30 min.

Assays

Specific enzyme protein analysis was carried out by ELISA. All samples were analyzed for Lipex. An enzyme protein standard curve was analyzed on every microtiter plate. Samples were analyzed in 2-fold dilution series in duplicate, samples that did not give reliable results were re-analyzed the following day. The enzyme exposure was calculated for each filter.

Results

Adsorbed enzyme was eluted from the filters used during the enzyme exposure assessment. This was subsequently analyzed using ELISA technology. Detailed exposure data are found in Table 2.

Discussion

Spraying

The enzyme exposure data shows that spraying with the standard spray nozzle results in exposure between 24 and 31 ng/m$^3$.

Brushing

Enzyme exposure during brushing was determined four times and showed exposure below the detection limit in all these measurements.

Wet Vacuum Removal of the Product

In two cleaning cycles the product was removed from the floor using the wet vacuuming system that is installed in the caddy. For the two products (standard cleaning composition and anti-mist formulation) that were applied using the normal spray nozzle the exposure was below the detection limit, <1.42 ng active enzyme protein/m$^3$.

The assessment was made using the Formulations described above with the product being applied to the floor. In order to make this assessment a set of filters were mounted close to the exhaust pipe, the pumps were started and the product was removed according to the same procedure as previously. The enzyme exposure was below the detection limit.

Squeegee Removal of the Product

The product was also removed using squeegee to determine the exposure when the cleaning solution is removed through the floor drain. The exposure from this application was determined to be <1.42 ng active enzyme protein/m$^3$.

Average Exposure During the Whole Cycle

The exposure measurements performed over the whole cleaning cycle is coherent with the exposure from the individual measurements. All three formulas have one individual process that generates exposure significantly higher than the other individual processes, and this is thus the major contributor to the average exposure. In this exposure assessment we are focusing on peak exposures that are generated during each specific cleaning process.

Enzyme allergies may develop when humans are exposed to active enzyme protein through inhalation. Routes of exposure are through aerosolized enzyme protein or enzyme dusts. Due to the REACH legislation in EU a derived minimal effect level (DMEL) for enzymes has been adopted throughout the enzyme industry and the detergent industry as guidance. The DMEL describes the threshold value for enzyme exposure, and when the exposure is kept under this level, the risk of developing allergy is very low. The corresponding DMEL for occupational exposure is set to 60 ng/m$^3$ as peak exposure.

Outside EU the ACGIH Threshold Limit Value of 60 ng/m$^3$ for occupational peak exposure is applied in most countries. However, UK authorities have installed an additional Threshold Limit Value of 40 ng/m$^3$ for average occupational exposure during 8 hours.

Conclusion

Appropriate metering tips were determined for the standard sprayer on the caddy that dispense the correct amount of polyox solution of 1.56% (2 oz/gal). When comparing the polyox and non polyox solutions through each sprayer, no significant difference was seen in spray pattern or antimisting. Polyox is added to the solutions to increase particle size and is a traditional mechanism for attempting to reduce aerosolization of proteins. Quite surprisingly, applicants have found that aerosolization may be better controlled without any additives and through spraying parameters discussed herein. The addition of polyox did not result in any significant difference in aerosolization.

TABLE 2

| Procedure | Product | Sample ID | Monitoring position | Monitoring time [min] | Air flow [L/min] | Air volume [m3/filter] | Lipex exposure [ng/ml] | [ng/filter] | [ng/m3] | Average [ng/m3] |
|---|---|---|---|---|---|---|---|---|---|---|
| Blank | | 7918 | | 15 | 25 | 0.375 | <0.078 | <0.039 | <1.04 | <1.04 |
| Whole cycle | Standard | 7919 | Left | 33 | 25 | 1.825 | 1.29 | 6.4 | 8 | 9.8 |
| | | 7921 | Right | 33 | 25 | 0.825 | 1.96 | 9.8 | 12 | |

TABLE 2-continued

| Procedure | Product | Sample ID | Monitoring position | Monitoring time [min] | Air flow [L/min] | Air volume [m3/filter] | Lipex exposure [ng/ml] | [ng/filter] | [ng/m3] | Average [ng/m3] |
|---|---|---|---|---|---|---|---|---|---|---|
| Spray | Standard | 7920 | Left | 11 | 25 | 0.275 | 1.142 | 5.7 | 21 | 24.5 |
| | | 7922 | Right | 11 | 25 | 0.275 | 1.56 | 7.8 | 28 | |
| Brushing | Standard | 7923 | Left | 11 | 25 | 0.275 | <0.078 | <0.039 | <1.418 | <1.418 |
| | | 7924 | Right | 11 | 25 | 0.275 | <0.078 | <0.039 | <1.418 | |
| Wet vacuum | Standard | 7925 | Left | 11 | 25 | 0.275 | <0.078 | <0.039 | <1.418 | <1.418 |
| | | 7926 | Right | 11 | 25 | 0.275 | <0.078 | <0.039 | <1.418 | |
| Blank | | 7927 | | 15 | 25 | 0.375 | <0.078 | <0.039 | <1.04 | <1.04 |
| Whole cycle | Sanitizing | 7928 | Left | 33 | 25 | 0.825 | 1.64 | 8.2 | 10 | 14.5 |
| | | 7929 | Right | 33 | 25 | 0.825 | 3.15 | 15.7 | 19 | |
| Spray | Sanitizing | 7930 | Left | 11 | 25 | 0.275 | 1.64 | 8.2 | 30 | 27.9 |
| | | 7931 | Right | 11 | 25 | 0.275 | 1.44 | 7.2 | 26 | |
| Brushing | Sanitizing | 7932 | Left | 11 | 25 | 0.275 | <0.078 | <0.039 | <1.418 | <1.418 |
| | | 7933 | Right | 11 | 25 | 0.275 | <0.078 | <0.039 | <1.418 | |
| Squeegeeing | Sanitizing | 7934 | Left | 11 | 25 | 0.275 | <0.078 | <0.039 | <1.418 | <1.418 |
| | | 7935 | Right | 11 | 25 | 0.275 | <0.078 | <0.039 | <1.418 | |
| Blank | | 7936 | | 15 | 25 | 0.375 | <0.078 | <0.039 | <1.04 | <104 |
| Whole cycle | Antimist | 7937 | Left | 33 | 25 | 0.825 | 0.94 | 4.7 | 6 | 7.7 |
| | | 7938 | Right | 33 | 25 | 0.825 | 1.59 | 8.0 | 10 | |
| Spray | Antimist | 7939 | Left | 11 | 25 | 0.275 | 1.46 | 7.3 | 25 | 31.0 |
| | | 7940 | Right | 11 | 25 | 0.275 | 1.96 | 9.8 | 36 | |
| Brushing | Antimist | 7941 | Left | 11 | 25 | 0.275 | <0.078 | <0.039 | <1.418 | <1.418 |
| | | 7942 | Right | 11 | 25 | 0.275 | <0.078 | <0.039 | <1.418 | |
| Wet vacuum | Antimist | 7943 | Left | 11 | 25 | 0.275 | 0.15 | 0.8 | 3 | 2.1 |
| | | 7944 | Right | 11 | 25 | 0.275 | <0.078 | <0.039 | <1.418 | |

What is claimed is:

1. A method for application of a chemical composition including enzymes with a pressurized spraying system, the method comprising:

preparing a water thin use solution of the chemical composition, the use solution comprising from about 0.0001 to about 0.2 wt. % enzyme-containing concentrate, a pH modifier, and a surfactant, wherein the total amount of surfactant is from about 0.1 to about 25 wt. %, and wherein the composition is substantially free of anti-mist components;

applying the use solution as a spray through a spray nozzle to a hard surface to be cleaned using pressure of 25 to 75 psi and a flow rate of about 0.5 to about 0.75 gal/min, wherein the spray has a particle size of about 675 to about 1500 μm, and wherein the method maintains aerosolized enzymes below 60 ng/m$^3$.

2. The method of claim 1 wherein the chemical composition is removed from said hard surface by wiping said hard surface so that dirt and debris on said hard surface are removed with the chemical composition.

3. The method of claim 1 wherein said enzyme is lipase.

4. The method of claim 1, wherein the spray nozzle is attached to a spray gun having a trigger mechanism.

5. The method of claim, 1 wherein said spray has a particle size of approximately 750 microns.

6. The method of claim 1, wherein the enzyme-containing concentrate comprises from about 1 wt. % to about 2.5 wt. % lipase.

7. The method of claim 6, wherein the chemical composition is diluted to 2 ounces per gallon of water to form the use solution.

8. The method of claim 1, wherein the method maintains aerosolized enzymes below 40 ng/m$^3$.

9. The method of claim 1, wherein the anti-mist components are selected from the group consisting of polyethylene oxide, polyacrylamide, polyacrylate, and combinations thereof.

10. The method of claim 1, wherein the spray is produced at a 25 degree angle.

11. The method of claim 1, wherein the spray nozzle has an inlet diameter of ¼ inch.

12. The method of claim 1, wherein the surfactant is selected from the group consisting of: anionic, nonionic, cationic, amphoteric surfactants and mixtures thereof.

13. The method of claim 12 wherein the surfactant is selected from the group consisting of: alkylbenzene sulfonates, sodium xylene sulfonates, sodium dodecylbenzene sulfonates, sodium linear tridecylbenzene sulfonates, potassium octyldecylbenzene sulfonates, sodium lauryl sulfate, sodium palmityl sulfate, sodium cocoalkyl sulfate, sodium olefin sulfonate, $C_{6-24}$ alcohol ethoxylates, alkyl polyglycosides, ethoxylated alkylamines, alkoxylates of ethylenediamine, 1-(2-hydroxyethyl)-2-imidazoline, a 2-alkyl-1-(2-hydroxyethyl)-2-imidazoline, n-alkyl($C_{12}$-$C_{18}$) dimethylbenzyl ammonium chloride, n-tetradecyldimethylbenzylammonium chloride monohydrate, dimethyl-1-naphthylmethylammonium chloride, sulfobetaines, N-coco-3,3-aminopropionic acid, n-tallow-3-amino-dipropionate disodium salt, 1,1-bis(carboxymethyl)-2-undecyl-2-imidazolinium hydroxide disodium salt, cocoaminobutyric acid, cocoaminopropionic acid, cocoamidocarboxy glycinate, cocobetaine, cocoamidopropylbetaine, polyether siloxane, cocoaminoethylbetaine, dimethylcetylamine oxide, dimethyllaurylamine oxide, dimethylmyristylamine oxide, dimethylstearylamine oxide, dimethylcocoamine oxide, dimethyldecylamine oxide, and mixtures thereof.

14. The method of claim 1, wherein the pH modifier is selected from the group consisting of hydrochloric acid, nitric acid, phosphoric acid, sulfuric acid, citric acid, glycolic acid, lactic acid and mixtures thereof.

15. The method of claim 1, wherein the chemical composition further comprises an enzyme stabilizer, a water conditioning agent, and a hydrotope.

16. A method for application of a chemical composition including enzymes with a pressurized spraying system, the method comprising:

preparing a water thin use solution of the chemical composition, the use solution comprising from about 0.0001 to about 0.2 wt. % enzyme-containing concentrate, a pH modifier, and a surfactant, wherein the total amount of surfactant is from about 0.1 to about 25 wt. %;

applying the use solution as a spray through a spray nozzle to a hard surface to be cleaned using pressure of 25 to 75 psi and a flow rate of about 0.5 to about 0.75 gal/min, wherein the spray has a particle size of about 675 to about 1500 μm, and wherein the method maintains aerosolized enzymes below 60 $ng/m^3$.

17. A method for application of a chemical composition including enzymes with a pressurized spraying system, the method comprising:

preparing a water thin use solution of the chemical composition, the use solution comprising from about 0.0001 to about 0.2 wt. % enzyme-containing concentrate, a pH modifier, and a surfactant, wherein the total amount of surfactant is from about 1 to about 10 wt. %, and wherein the composition is substantially free of anti-mist components;

applying the use solution as a spray through a spray nozzle to a hard surface to be cleaned using pressure of 25 to 75 psi and a flow rate of about 0.5 to about 0.75 gal/min, wherein the spray has a particle size of about 675 to about 1500 μm, and wherein the method maintains aerosolized enzymes below 60 $ng/m^3$.

18. The method of claim 17, wherein the surfactant is selected from the group consisting of: anionic, nonionic, cationic, amphoteric surfactants and mixtures thereof.

19. The method of claim 18, wherein surfactant is selected from the group consisting of: alkylbenzene sulfonates, sodium xylene sulfonates, sodium dodecylbenzene sulfonates, sodium linear tridecylbenzene sulfonates, potassium octyldecylbenzene sulfonates, sodium lauryl sulfate, sodium palmityl sulfate, sodium cocoalkyl sulfate, sodium olefin sulfonate, $C_{6-20}$ alcohol ethoxylates, alkyl polyglycosides, ethoxylated alkylamines, alkoxylates of ethylenediamine, 1-(2-hydroxyethyl)-2-imidazoline, a 2-alkyl-1-(2-hydroxyethyl)-2-imidazoline, n-alkyl($C_{12}$-$C_{18}$) dimethylbenzyl ammonium chloride, n-tetradecyldimethylbenzylammonium chloride monohydrate, dimethyl-1-naphthylmethylammonium chloride, sulfobetaines, N-coco-3,3-aminopropionic acid, n-tallow-3-amino-dipropionate disodium salt, 1,1-bis(carboxymethyl)-2-undecyl-2-imidazolinium hydroxide disodium salt, cocoaminobutyric acid, cocoaminopropionic acid, cocoamidocarboxy glycinate, cocobetaine, cocoamidopropylbetaine, polyether siloxane, cocoaminoethylbetaine, dimethylcetylamine oxide, dimethyllaurylamine oxide, dimethylmyristylamine oxide, dimethylstearylamine oxide, dimethylcocoamine oxide, dimethyldecylamine oxide, and mixtures thereof.

20. The method of claim 17, wherein the pH modifier is selected from the group consisting of hydrochloric acid, nitric acid, phosphoric acid, sulfuric acid, citric acid, glycolic acid, lactic acid and mixtures thereof.

21. The method of claim 17, wherein the chemical composition further comprises an enzyme stabilizer, a water condition agent and a hydrotope.

* * * * *